United States Patent [19]

Meister

[11] Patent Number: 4,506,598

[45] Date of Patent: Mar. 26, 1985

[54] APPARATUS FOR THE HEATING OF FOODSTUFFS BY MEANS OF A STEAM-AIR MIXTURE

[76] Inventor: Siegfried Meister, Iglinger Strasse 62, 8910 Landsberg/Lech, Fed. Rep. of Germany

[21] Appl. No.: 341,192

[22] Filed: Jan. 20, 1982

[30] Foreign Application Priority Data

Oct. 31, 1981 [DE] Fed. Rep. of Germany ... 8131827[U]

[51] Int. Cl.[3] ..... A47J 27/04

[52] U.S. Cl. ..... 99/330; 99/339; 99/446; 99/447; 99/474; 126/20; 126/21 A; 126/369.1; 426/510; 426/523

[58] Field of Search ..... 99/447, 401, 446, 340, 99/469, 468, 330, 473, 474, 480, 339, 467; 219/400, 401; 126/20, 20.1, 20.2, 21 A, 369, 369.1, 369.2; 426/510, 523

[56] References Cited

U.S. PATENT DOCUMENTS

| | | | |
|---|---|---|---|
| 3,744,474 | 7/1973 | Shaw | 126/20 |
| 4,173,215 | 11/1979 | Bureau | 99/468 X |
| 4,189,995 | 2/1980 | Lohr | 99/447 |

FOREIGN PATENT DOCUMENTS

| | | | |
|---|---|---|---|
| 1102540 | 3/1961 | Fed. Rep. of Germany . | |
| 7118136 | 5/1971 | Fed. Rep. of Germany . | |
| 2541374 | 3/1977 | Fed. Rep. of Germany . | |
| 2801559 | 7/1978 | Fed. Rep. of Germany | 426/510 |

*Primary Examiner*—Billy J. Wilhite

*Attorney, Agent, or Firm*—Andrus, Sceales, Starke & Sawall

[57] ABSTRACT

Apparatus heats foodstuffs with a steam-air mixture circulated by a blower in the cooking chamber. The chamber has a controllable vapor vent at its top. A temperature regulator is located in the connection of the cooking chamber to the outer air located at the bottom of the chamber. A pivoted drain pipe coupled to the connection separately discharges condensed steam and food juices or fat.

10 Claims, 8 Drawing Figures

APPARATUS FOR THE HEATING OF FOODSTUFFS BY MEANS OF A STEAM-AIR MIXTURE

Figure 1:
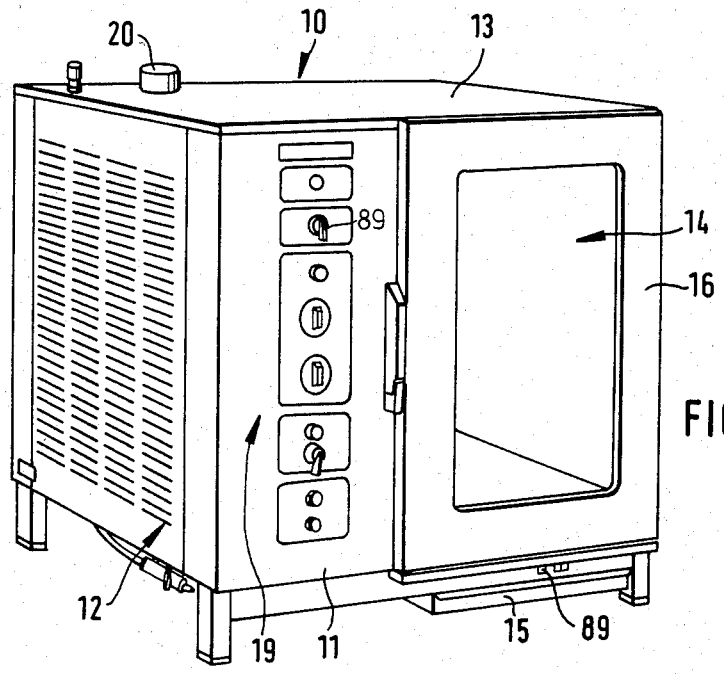

The invention relates to an apparatus for the heating of foodstuffs, in particular for the preparation of foods, by means of a steam-air-mixture as the heating medium. The heating medium is circulated at atmospheric pressure by means of a motor driven blower in a cooking space sealable through a door and provided with a controllable vapor vent and a condensate drain. The apparatus has a heating apparatus for the heating medium and a steam generator with a temperature regulated heating element.

With a known apparatus of this type, that however, is suitable only for the thawing and heating of deep frozen foods and foodstuffs, and not for preparation in the sense of cooking, roasting, or baking, the steam producer is installed in the form of a heated water bath on the bottom of the handling space and the steam producer is regulated through a thermostat, that is arranged in the vapor vent (DE-PS No. 1,102,540). The process is so controlled that in the apparatus, existing air is displaced by saturated steam as the heating medium with the object of taking advantage of the heat of condensation of the steam for rapid thawing and heating. Through the thermostat in the vapor vent the steam supply can be opened and closed by means of a valve arranged in the steam conduit. The steam emerges out of the vapor vent on the basis of its naturally free buoyancy before however, saturation is attained in the cooking space. A temperature measurement at the vapor vent furnishes moreover no reproducible control valve, if as is conventional, a throttle valve is arranged in the vapor vent pipe, because its setting and not the conditions in the heating space is or are determinative for the flow of the vent pipe. With a closed throttle valve, a regulation is, on the whole, impossible.

This known apparatus is unsuited for roasting and grilling because, with the saturated steam, roasting is impossible.

An apparatus for the preparation of foods by means of a circulating steam-hot air-mixture at atmospheric pressure is known from the DE-Gbm No. 7,118,136. Here the steam furnished from an external steam generator is supplied through a steam conduit in the pressure chamber of the blower, and an additional electrical heating device is arranged in the cooking space. However, neither the mixture proportions or the additional heating are regulated. Moreover, the arrangement of the heating element as heating rods in the cooking space beneath the grate is disadvantageous because the fat or juice dripping with roasting or grilling chars on the heating rods.

A similar apparatus is known from the DE-OS No. 2,541,374, in which the additional electrical heating apparatus is arranged reversed in the pressure chamber while steam produced in the separate location is fed in the cooking space. Through a temperature sensor arranged in the vapor vent, that is provided with a throttle valve and mounted on the cooking space, the steam supply can be switched on and switched off. The injection of the steam under pressure in the cooking space induces therein an unequal temperature distribution, the flow of which depends particularly strongly on its composition according to type and distribution. Also it is disadvantageous with this apparatus that the steam escapes through the vapor vent and the temperature sensor closes the steam supply before the cooking space is completely filled with steam. A baffle place mounted in front of the inlet opening of the steam can not dispose of this disadvantage and it decreases instead the size of the usable cooking space.

A combined disadvantage of this and other apparatus is that the steam partial pressure is not optimal with atmospheric pressure in the cooking space and moreover is subject to strong fluctuations at intervals through the injection of steam. Moreover, it fails in optimization relative to occupied space, technical expenditure and therewith initial and operating costs as well as maintenance expenditures, that are requirements for rational application in gastronomic enterprises, canteens or the like.

The invention has as its object to provide an apparatus of the initially named type so improved and formed that in it, foodstuffs and food can be prepared in every manner and way in an energy saving manner with optimal preservation of their components.

The solution lies in the appreciation that despite a construction technically simplified on the basis of economy and compact on the basis of space, the moisture content, that is steam partial pressure in the cooking space must be regulatable with atmospheric pressure to an optimal value that in particular is thus specified that only so much steam is produced and is supplied at regular intervals as can be used for the acceleration of the thawing or cooking process through discharge of the heat of condensation on the foodstuffs and food. An excess in steam would be discharged uselessly in the outer air. The object of the invention is thus achieved in that the sensor of the associated temperature regulator is arranged in a connection of the cooking space to the outer air through which the steam-air-mixture can emerge only after filling up the cooking space.

With the arrangement of the sensor of the temperature regulator according to the invention, the discharge of excess steam can be sensitively controlled and this control function is fully separated from the function of the throttle valve in the vapor vent. The apparatus is also so controlled that the steam production is interrupted or braked, as soon as steam emerges out of the cooking space through the connection to the outer air, after first surmounting a specified vacuum, determined through the form of the connection, produced in the cooking space.

The cooler outer air is oppositely drawn into the cooking space as soon as a vacuum appears in the cooking space after the interruption or reduction of the steam production through condensation of the residual steam. This is—if the cooking time has not yet run out—the point in time at which, further fresh steam is fed into the cooking space. The sensor of the temperature regulator registers the lower temperature of the drawn-in outer air and again switches the steam production on. This "breathing" of the cooking space-atmosphere attained according to the invention can produce, without special requirements in the sensitivity of the sensor, a swift response to the pressure fluctuations in the cooking space without hysteresis effects.

It is preferred that the connection of the cooking space to the outer air, at least on a part of its length, is downwardly directed. In this part the steam is led downwardly against its natural lift by corresponding vacuum in the cooking space.

Preferably the discharge location of the steam out of the connection of the cooking space to the outer air should lie as low as possible with reference to the cooking space.

With a preferred exemplary form of the invention, the free end of a connection conduit opens out of the cooking space in a drain pipe, which is preferably part of a T-pipe element pivotable about the axis of the drain pipe between two end positions. The one end position of the T-pipe element directs a discharge pipe for the water condensed out of the steam connected with the drain pipe downwardly and an outflow pipe connected with the drain pipe provided for the draining of the food components, while in the other end position the discharge pipe is directed upwardly and the outflow pipe is directed downwardly. In the one end position of the T-pipe element the condensed water flows through the discharge pipe in an available syphon, while with the roasting, for example of meat, with hot air, the T-pipe element is pivoted in the other end position and the food components draining out of the cooking space can flow out through the downwardly directed outflow pipe in an available fat connection pan. Through these measures it is prevented that the food components flowing out through the discharge pipe can arrive in the waste water conduit.

The troublesome escape of residual steam—that for the control through the sensor is necessary—in the outer space is according to a further form of the invention thus prevented in that a steam quenching device is axially arranged in the drain pipe. The sensor of the temperature regulator is then arranged in the connection conduit upstream relative to the steam quenching device.

Figure 2:
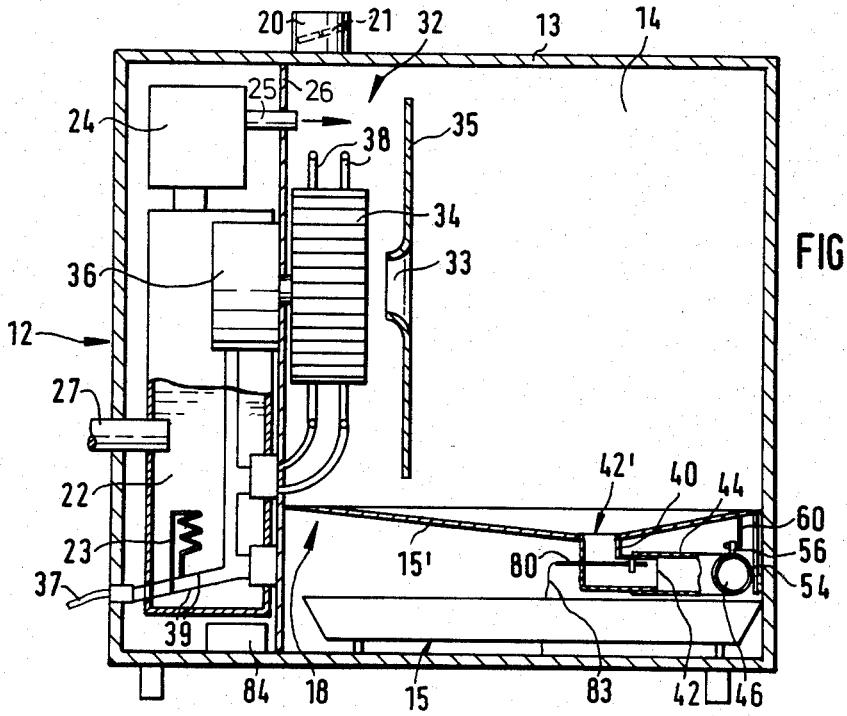
Figure 3:
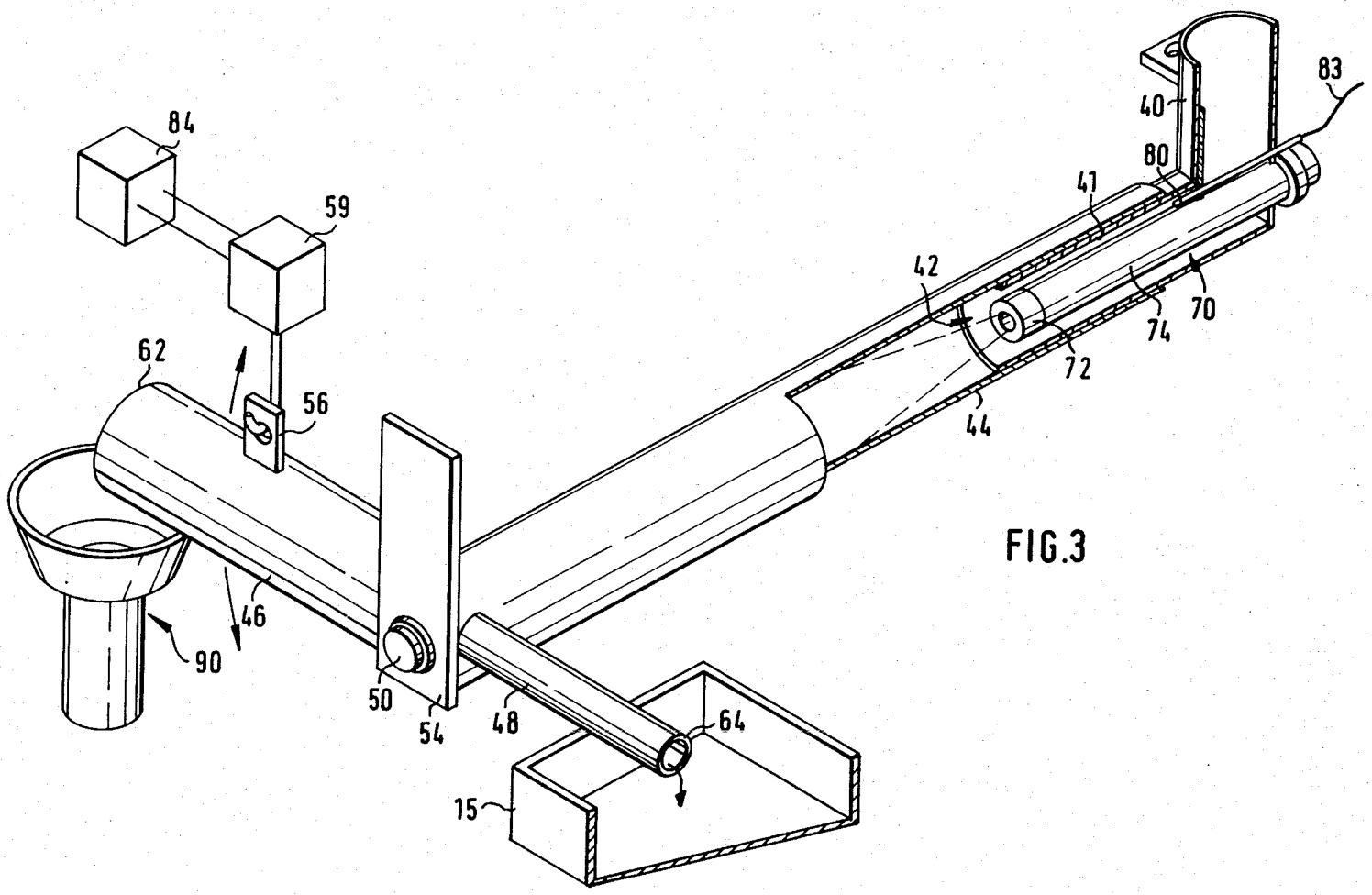
Figure 3A:
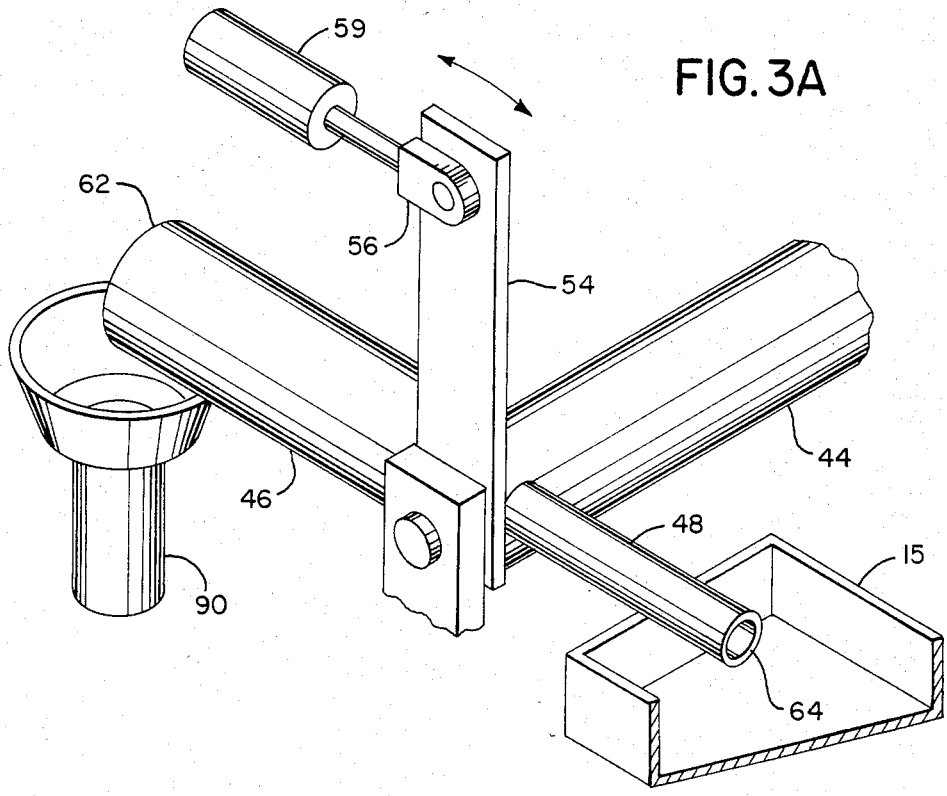

The invention is explained in detail below with the aid of an exemplary embodiment shown in the attached drawings. The drawings show:

FIG. 1 a perspective view of a combination steam apparatus;

FIG. 2 a schematic representation of the operating parts and of the cooking space, as well as the condensate drain device;

FIG. 3 a schematic representation of the condensate drain device in greatly increased scale;

FIG. 3A a modification of the condensate drain device.

Figure 4A:
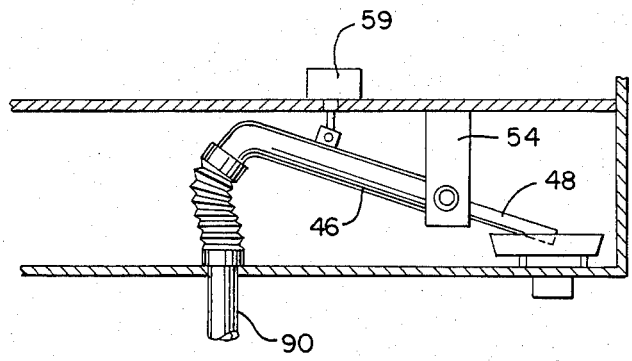
Figure 4:
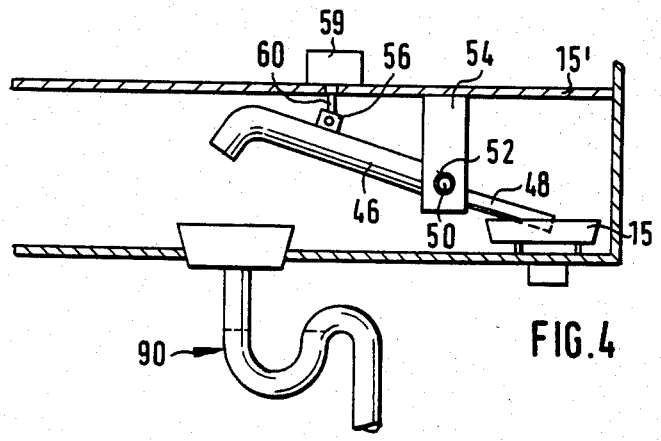
Figure 5:
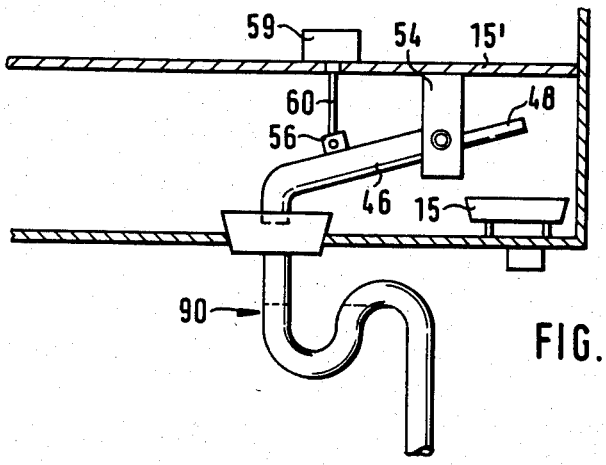

FIG. 4 and 5 a schematic representation of the rocker-operating positions;

FIG. 4A a further modification of the condensate drain device.

Figure 6:
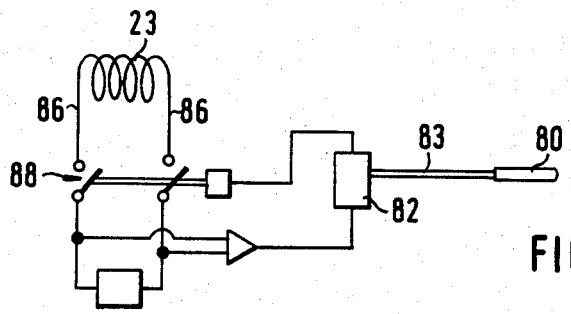

FIG. 6 a schematic circuit diagram for the explanation of the mode of operation of the temperature regulator.

As shown in FIG. 1, the housing 10 contains an operating portion 12 and a cooking space 14 arranged next to it, that is accessible from outside through a door 16 for the insertion of foodstuffs and foods placed on racks. Beneath the bottom 18 of the cooking space 14, a fat collection pan 15 is removably fastened.

The apparatus is connected through a power cord 37 to a not disclosed current source. Through actuation of a control, indicated in its entirety by 19 arranged in the front wall 11 of the operating portion 12, the desired operating phases of the combination-steam apparatus can be regulated as desired.

As shown in FIG. 2, the operating portion 12 contains a steam generator formed out of a water boiler 22 with an integral, schematically shown electrical heating apparatus 23 and a steam dome 24 arranged at the upper end. A steam discharge conduit 25 opens out of the steam dome into a pressure chamber 32 on the other side of a dividing wall 26 separating the operating portion 12 from the cooking space 14. The water boiler 22 is connected with a water supply conduit, that is schematically indicated by 27.

In the pressure chamber 32, an axial blower wheel 34 is horizontally supported generally in the middle of the dividing wall 26. An electric motor 36 arranged in operating part 12 drives the drive shaft of the blower wheel. The blower wheel 34 is surrounded on the circumference by a plurality of spaced, ring formed electrical heating elements 38, that are supplied through electrical conduit 39. In front of the blower wheel 34, as completion of the cooking space 14, a flow directing place 35 is fastened, that defines the pressure chamber 32 from the cooking space. As the flow guiding plate 35 is spaced from the covering wall 13 and the base plate 15' as well as, in a not disclosed manner, from the side walls of the cooking space 14, the pressure chamber 32 is connected with the cooking space 14 through these intermediate spaces and in addition to that through a middle opening 33 in the flow guiding plate 35. The base plate 15' is formed as a flat funnel, that has, at its deepest point, a bottom opening 42' leading into a connection conduit 40. In the covering wall 13, an adjustable flap valve 21 is arranged in a vapor vent 20 in the region of the pressure chamber 32.

Among others, the combination-steam apparatus possesses two main operating phases.

In the first operating phase, that is suitable, for example, for the thawing, heating, cooking, and steaming of the foodstuffs and foods provided in cooking space 14 and is termed in short the "steam phase", the energized heating apparatus 23 in the water boiler 22 produces the necessary amount of steam, that gains the pressure chamber 32 out of the steam dome 24 through the steam supply conduit 25 and from there is blown through the blower wheel 34 into the cooking space 14. The heat of condensation of the steam is discharged into the food and the contents in the cooking space and the condensed water arrives in the connection conduit 40 through the base opening 42'.

In the second operating phase ("hot air" phase), that is provided for the roasting and grilling of the food in the cooking space 14, the heating apparatus 23 is switched off and the heating elements 38 surrounding the blower wheel 34 are switched on. The foods are then treated with hot air. Fat and meat juice drips from the foodstuffs with such treatment and runs through the bottom opening 42' in the connection conduit 40.

Also, a combined operation is possible, by which the steam-air mixture is reheated through the heating elements 38.

With the previously explained combi-steam apparatus a special device is provided, according to the invention, beneath the base plate 15' of the cooking space 14 for the control of the temperature regulator for the heating apparatus 23 in the water boiler 22 and for the draining of the condensate out of the cooking space 14. As FIG. 3 shows in detail, the connection conduit 40 begun at the base opening 42' is formed in the shape of a knee pipe, the free leg 41 of which comprises the front part of a drain pipe 44. The drain pipe 44 opens, on the distal end of the free leg 41 into a transverse fastened discharge pipe 46. In the area of the connection point of the drain pipe 44 with the discharge pipe 46, a component outflow pipe 48 is fastened and extends in a direction, that is opposite to the direction of the discharge pipe 46. The discharge pipe 46 carries, in an axial extension of the axis of the drain pipe 44, a projecting trunion 50, that is rotatably supported in a bore 52 of a shackle 54 fastened with the housing 10. The discharge pipe 46 carries on its upper outer side a loop 56 provided with an eye. In the loop 56 the control member of a regulating mechanism engages, to which belongs, in the disclosed exemplary embodiment, a solenoid 59 fastened on the housing 10, the extending armature 60 of which is suspended in the eye of the loop 56.

The free end 62 opens above the opening of a syphon indicated in its entirety by 90. The free end 64 of the juice outflow pipe 48 lies above the fat collection pan 15.

A steam quenching apparatus 70, which in the disclosed exemplary embodiment is a water pipe 74 closed with a spray nozzle 72, is axially arranged in the free leg 41. This steam quenching apparatus 70 can however also be provided in the drain pipe 44 or in the discharge pipe 46. In any case, the sensor 80 of the temperature regulator 82 (FIG. 6) is arranged relative to the steam quenching apparatus 70 in the free leg 41 of the connection conduit 40 on the upstream side and is connected through a signal conductor 83 with the temperature regulator 82.

The apparatus works in both main operating phases as follows:

With the steam, the central control 84 of the apparatus obtains from the control 19, a signal in such a manner that the magnet 59 can extend its armature, so that the T-pipe piece formed out of drain pipe 44, discharge pipe 46 and juice outflow pipe 48 pivots in the end position illustrated in FIG. 5 owing to its pivotal support on the free leg 41 and in the bore 52 of shackle 54. In such end position the discharge pipe 46 is directed downwardly and the juice outflow pipe 48 is directed upwardly. The sensor 80 acts upon the temperature regulator 82 in the manner that switch 88 lying in the power supply conductor 86 of the heating apparatus 23 is closed and the heating apparatus 23 heats up the water in water boiler 22. The resulting steam exits out of the dome 24 through the steam supply conduit 25 into the pressure chamber 32 and from there in the cooking space 14. When the steam displaces the air out of the cooking chamber 14 through the connection conduit 40, the steam emerges out of the cooking space 14 through the connection conduit 40, and the valve 21 in the vapor vent 20 is closed. Ahead of the emergence of the steam out of the drain pipe 44, the steam is separated through the steam quenching apparatus 70. This water and the condensate flows out of the cooking space 14 through the discharge pipe 46 in the syphon 90.

The sensor 80 detects the emergence of the steam and acts on the temperature regulator 82 in a manner such that the switch 88 is opened, so that further steam production is retarded and, if necessary, is interrupted. The steam in cooking area 14 increasingly condenses on the contained foodstuffs and food, so that in the cooking space 14 a vacuum developes with the result that air is drawn in from outside through the connection conduit 40. The sensor 80 detects the cooling through the inward flowing fresh air and acts on the temperature regulator 82 so that the switch 88 is closed. There thus commences a new production of steam. The intermittent steam generation in the course of the steaming effects a breathing of the atmosphere in the cooking space 14, so that it is held at constant optimal value of the steam concentration.

When the foodstuffs in the heating chamber are treated only with hot air, the valve 21 is opened so that vapor can escape out of the cooking chamber.

The control 19 actuated in accordance with the program now acts on the central control 84 in the manner such that the solenoid 59 can attract its armature 60 so that the rocker formed out of the T-pipe piece occupies the end position shown in FIG. 4. In this position, the discharge pipe 46 is upwardly directed and the juice outflow pipe 48 is downwardly directed. The fat and food components dripping off during the hot air treatment of the food and foodstuffs leaves the cooking space through the base opening 42' and the connection conduit 40 and is drained off through the drain conduit 44 and the juice outflow pipe 48 in the available fat collection pan 15. Through the end position shown in FIG. 4, the rocker insures that no fat or food components can run out into the syphon 90.

The invention is not limited to the details of the illustrated embodiment. It lies within the scope of the invention, to realize the positioning device for the rocker also through a linkage that is operable through a separate control knob 89 from outside. Further instead of the solenoid magnet 59 a rotary magnet can be provided on the shackle 54, that pivots the rocker formed of the T-pipe piece through deflection of the journal into each one of the end positions, as shown in FIG. 3A. Moreover, it is advisable to connect the discharge pipe 46 on its free end through a flexible sleeve or the like with the waste water pipe installed in the building, so that the syphon can be discarded, if desired, as shown in FIG. 4A. Finally the connection conduit can open also through the side wall or rear wall in the cooking space instead of through the base plate 15'.

I claim:

1. Apparatus for the heating of foodstuffs with a steam or air heating medium comprising:

a cooking chamber (14) receiving the foodstuff for being heated by the heating medium, said cooking chamber having a controllable vapor vent (20) and an outlet (40) through which the steam heating medium can escape only after the chamber is filled with the steam heating medium;

a steam generator (22) for supplying steam heating medium to said chamber, said generator having a regulatable heating element (23, 82) controlling the generation of steam;

means (34) for circulating said heating medium in said chamber;

heating means (38) within said cooking chamber for heating the heating medium in said chamber;

a sensor (80) operatively associated with said cooking chamber outlet (40) and coupled to said regulatable heating element (23, 82) of said steam generator (22) for controlling said element and the generation of steam responsive to the presence of steam at said outlet (40);

a fat collection pan (15); and said outlet (40) including a drain pipe (44) for water condensed out of the steam at said outlet, said drain pipe having an opening (64) over said fat collection pan (15) for draining food substances into said pan (15).

2. The apparatus according to claim 1 characterized in that the outlet (40) of the cooking chamber (14) is directed downwardly along at least a part of its length.

3. The apparatus according to claim 1 wherein said outlet (40) of said cooking chamber (14) has a discharge (42) for the steam that is positioned as low as possible in said apparatus with respect to the cooking chamber (14).

4. The apparatus according to claim 1 wherein said outlet (40) opens into one end of the drain pipe (44), wherein said drain pipe (44) has a condensed water discharge pipe (46) at the other end arranged transversely to the drain pipe.

5. The apparatus according to claim 4 wherein said outlet (40) opens into one end of the drain pipe (44), wherein said drain pipe (44) is mounted on said outlet (40) for pivotal movement about the axis of the drain pipe, and wherein said discharge pipe and a substance-outflow pipe (48) containing said food substance opening (64) are arranged transversely to the axis of the drain pipe at the other end of said drain pipe and extend in opposite directions from said axis.

6. The apparatus according to claim 5 including electromotive means coupled to said drain pipe for pivoting said drain pipe between two defined end positions, in a first end position, the discharge pipe (46) is directed upwardly and the outflow pipe (48) is directed downwardly and in a second end position the discharge pipe is directed downwardly and the outflow pipe is directed upwardly.

7. The apparatus according to claim 4 characterized in that a steam quenching device (70) is arranged in one of said drain pipe (44) and said discharge pipe (46).

8. The apparatus according to claim 7 wherein said sensor (80) is arranged in said outlet upstream relative to the steam quenching device.

9. The apparatus according to claim 1 characterized in that the drain pipe (44) rotatably telescopically surrounds the outlet (40).

10. The apparatus according to claim 1 wherein said discharge pipe (44) is flexibly connected with an existing waste water pipe.

* * * * *